US010456613B1

(12) United States Patent
Copeland

(10) Patent No.: US 10,456,613 B1
(45) Date of Patent: Oct. 29, 2019

(54) ADJUSTABLE STRETCHING APPARATUS

(71) Applicant: Larry Copeland, Denver, CO (US)

(72) Inventor: Larry Copeland, Denver, CO (US)

( * ) Notice: Subject to any disclaimer, the term of this patent is extended or adjusted under 35 U.S.C. 154(b) by 166 days.

(21) Appl. No.: 15/673,441

(22) Filed: Aug. 10, 2017

(51) Int. Cl.
*A63B 21/00* (2006.01)
*A63B 23/00* (2006.01)

(52) U.S. Cl.
CPC ..... *A63B 21/00047* (2013.01); *A63B 23/00* (2013.01); *A63B 2023/006* (2013.01)

(58) Field of Classification Search
CPC .... A63B 1/00; A63B 3/00; A63B 9/00; A63B 2009/006; A63B 17/00; A63B 17/02; A63B 17/04; A63B 21/00047; A63B 21/0005; A63B 21/00054; A63B 21/00058; A63B 21/00065; A63B 21/00069; A63B 21/00072; A63B 21/00076; A63B 21/00185; A63B 21/002; A63B 21/0023; A63B 21/068; A63B 21/08; A63B 21/15; A63B 21/159; A63B 21/16; A63B 21/4023; A63B 21/4027; A63B 21/4033; A63B 21/4034; A63B 21/4035; A63B 21/4041; A63B 21/4043; A63B 23/00; A63B 2023/006; A63B 26/00; A63B 26/003; A63B 71/0036; A63B 2210/00; A63B 2210/50; A63B 2225/09; A63B 2225/093
USPC ..... 482/907
See application file for complete search history.

(56) References Cited

U.S. PATENT DOCUMENTS 670,144 A * 3/1901 Bond ..... F16M 11/00 126/30
1,089,290 A * 3/1914 Thompson ..... F16M 11/00 211/205
1,670,390 A * 5/1928 Strom ..... A63B 9/00 482/142
2,949,298 A * 8/1960 Speelman ..... A63B 9/00 472/135
3,204,779 A * 9/1965 Warner ..... A47F 5/13 211/182
3,207,511 A * 9/1965 Hoffman ..... A63B 17/00 482/104

(Continued)

FOREIGN PATENT DOCUMENTS

WO 2004004839 1/2004

OTHER PUBLICATIONS https://google.com/search?q=stretch?q=stretch+cage&oq=stretch+cage&aqs=chrome..69i57j015.6560j0j8&sourceid=chrome&ie=UTF-8 Stretch Cage.

*Primary Examiner* — Gary D Urbiel Goldner
(74) *Attorney, Agent, or Firm* — Patent Law Offices of Rick Martin, P.C.

(57) ABSTRACT

A stretching/exercising apparatus that is structured and adapted to assist a user in stretching and/or exercising various portions of his or her body is presented herein. At least a portion of the apparatus is at least partially adjustable or positionable in order to accommodate users of different heights, strengths or stretching capabilities. Specifically, one or more horizontal support posts may be height-adjusted along a main vertical post or stanchion in order to vary the configuration of the apparatus for different stretching techniques and advancement levels. The apparatus may be substantially constructed of lightweight wood or other lightweight materials, and thus easily moved or transported from one location to another.

14 Claims, 5 Drawing Sheets

(56) References Cited

U.S. PATENT DOCUMENTS 3,472,509 A * 10/1969 Flynn ..... A63B 17/00 182/129
3,735,979 A * 5/1973 Levenberg ..... A63B 9/00 482/143
4,068,761 A * 1/1978 McCarthy ..... A47G 7/045 211/134
4,497,279 A * 2/1985 Bell ..... A01K 15/027 119/706
4,527,797 A * 7/1985 Slade, Jr. ..... A63B 21/0626 482/101
4,540,171 A * 9/1985 Clark ..... A63B 21/00181 482/106
4,582,320 A * 4/1986 Shaw ..... A63B 21/00072 482/130
4,889,246 A * 12/1989 Lee ..... A47F 5/02 211/163
4,955,604 A * 9/1990 Pogue ..... A63B 21/078 482/106
5,082,260 A * 1/1992 Dinelli ..... A63B 21/078 482/104
5,156,580 A * 10/1992 Holland ..... A63B 1/00 482/38
D334,855 S * 4/1993 Harrington ..... D6/681.3
5,252,076 A * 10/1993 Kelleher ..... A63B 69/00 473/438
5,389,055 A * 2/1995 Gangloff ..... A63B 1/005 482/142
5,536,229 A 7/1996 Albergo
5,538,487 A * 7/1996 Fulmer ..... A63B 3/00 482/41
5,662,556 A * 9/1997 Gangloff ..... A63B 1/005 482/17
5,678,698 A * 10/1997 Cabral ..... A47F 5/04 211/33
5,776,037 A * 7/1998 Millington ..... A63B 21/4029 482/142
5,813,951 A * 9/1998 Einsig ..... A63B 21/06 482/1
5,862,924 A * 1/1999 Dumont ..... A47F 5/04 211/118
5,997,448 A 12/1999 Duba
6,120,415 A 9/2000 Paull et al.
6,145,674 A * 11/2000 Spearman ..... A47B 81/00 211/59.1
6,299,568 B1 * 10/2001 Prok ..... A63B 23/00 482/104
6,575,880 B1 * 6/2003 Hengtrakulsin . A63B 21/00072 482/100
6,780,122 B2 * 8/2004 Belanger ..... A63B 69/3623 473/257
D496,191 S * 9/2004 Johnson ..... D6/681.3
6,925,754 B1 * 8/2005 Tearoe ..... A01G 9/12 172/371
7,309,303 B1 * 12/2007 Proctor ..... A63B 3/00 482/121
7,455,621 B1 * 11/2008 Anthony ..... A63B 21/0724 482/3
D599,601 S * 9/2009 Mallen ..... D32/58
7,666,118 B1 * 2/2010 Anthony ..... A63B 21/0724 482/104
7,871,360 B1 * 1/2011 Hoole ..... A63B 23/12 482/121
7,918,770 B1 * 4/2011 Hoole ..... A63B 23/03525 482/105
8,020,716 B2 * 9/2011 Vitale ..... A47B 57/06 211/197
8,147,389 B1 * 4/2012 Hoole ..... A63B 23/1227 482/100
9,302,144 B1 * 4/2016 Benavides ..... A63B 21/068
9,428,204 B2 * 8/2016 Nunnikhoven ..... B62B 3/04
9,452,313 B2 * 9/2016 Thomas ..... A63B 21/0728
2002/0173370 A1 * 11/2002 Chapman ..... A63B 69/3667 473/258
2004/0058788 A1 * 3/2004 Thompson ..... A63B 21/068 482/95
2004/0176222 A1 9/2004 Mitchell
2005/0181914 A1 8/2005 Radkowski et al.
2006/0025284 A1 2/2006 Livingstone et al.
2006/0058158 A1 * 3/2006 McAvoy ..... A63B 1/00 482/38
2006/0089239 A1 4/2006 Davies, III
2007/0175848 A1 * 8/2007 Mallen ..... A47G 25/0671 211/196
2007/0197349 A1 8/2007 Gonzalez
2008/0312051 A1 12/2008 Manyseng
2009/0283360 A1 11/2009 Eckerdt
2010/0184573 A1 7/2010 Tucker et al.
2013/0108410 A1 * 5/2013 Nunnikhoven ..... B62B 3/04 414/809
2014/0066266 A1 3/2014 Chang
2015/0065312 A1 * 3/2015 Harrigan ..... A63B 69/32 482/84
2015/0076092 A1 * 3/2015 Tannbornino ..... A63B 21/078 211/85.7
2016/0023035 A1 * 1/2016 Meyer ..... A63B 1/00 482/38
2016/0184164 A1 6/2016 Browning
2017/0001056 A1 * 1/2017 Zanyk ..... A63B 21/0023
2017/0072242 A1 * 3/2017 Drain, II ..... A63B 21/068
2018/0126244 A1 * 5/2018 Doerr ..... A63B 71/0036
2018/0311523 A1 * 11/2018 Arturo ..... A63B 21/156

* cited by examiner

ADJUSTABLE STRETCHING APPARATUS

FIELD OF THE INVENTION

The present invention is generally directed to a stretching apparatus adapted to assist a user in stretching one or more portions of the body, including, but in no way limited to the user's legs, arms, back, and core. The stretching apparatus of certain embodiments may be lightweight to allow for easy transportation and/or movement thereof, and adjustable to accommodate users of different heights, weights and/or stretching capabilities.

BACKGROUND OF THE INVENTION

Regular stretching and exercising of the body and muscles is important to maintain flexibility, range of motion, and to prevent injury. Specifically, stretching keeps the body and muscles strong and healthy, and is a necessary addition to other exercises in order to achieve aerobic fitness and build muscle.

Failure to incorporate stretching into a regular fitness or everyday routine can cause the muscles to lose flexibility, stiffen and, in many cases, shorten. When undertaking an activity that requires muscles use, including both everyday activities such as walking or performing daily tasks or more strenuous activities such as jogging, running, exercising or working out, if the muscles have not been regularly stretched, they will be weak and unable to extend to their full potential. This can lead to joint pain, muscle damage or other permanent and serious injuries.

However, many people do not regularly stretch or exercise in that the idea of stretching on a regular basis, such as daily, may seem daunting or overwhelming. Furthermore, many people may not know how to best stretch or may want to have a device or apparatus that can help his or her stretch properly. There is thus a need in the art for a stretching apparatus that can be adjusted, modified or customized to accommodate people of different heights, weights, and stretching capabilities. The proposed apparatus can be adjusted such that a number of different stretching techniques or positions can be accomplished using the same apparatus, and that can be adjusted from easy or novice stretching levels or techniques to advanced levels or techniques. Other advantages are that the proposed stretching apparatus is lightweight and therefore easily transported or moved from one location to another, for example, into and out of a storage location, if desired.

SUMMARY OF THE INVENTION

Accordingly, the present invention is directed to a stretching and/or exercising apparatus that is structured and adapted to assist a user in stretching and/or exercising various portions of his or her body, including, but in no way limited to his or her leg(s), arm(s), back, core, etc. In some embodiments, at least a portion of the stretching apparatus is at least partially adjustable or customizable in order to accommodate users of different heights, strengths or stretching capabilities.

It should also be noted that the stretching apparatus of some embodiments of the present invention is lightweight, and thus easily moved or transported. For example, one or more portions of the apparatus can be constructed of or substantially of a lightweight wood (including but in no way limited to pine, fir, spruce or cedar) or other lightweight material such that the entire apparatus can be easily lifted and transported by any individual or user. This allows a user to easily transport the apparatus from one location to another, as desired, or to store the apparatus, for example, in a closet or other storage location, when not in use.

More in particular, the stretching apparatus includes a vertically oriented or substantially upright main post that has a plurality of through holes disposed along a length thereof, for example, between the bottom end and top end of the post. One or more horizontal or height-adjustable posts can be selectively inserted into and removed from the plurality of holes. By doing so, the user can modify the configuration of the stretching or exercising apparatus in order to provide different levels or advancement of stretching or exercising techniques.

Some embodiments may further include one or more fixed support posts or handles disposed in an outwardly or at least substantially horizontal orientation from the vertical post. The fixed support post(s) or handle(s) in some embodiments are not intended to be readily removed, and can be used for stability and/or leverage when using the device. However, it is contemplated that in some embodiments all or most of the horizontal posts, including the fixed support post(s) or handle(s), may be selectively removed from the vertical post, for example, in order to facilitate transportation and/or storage of the apparatus. In other embodiments, the fixed support post(s) or handle(s) may pivot downward, upward or otherwise in an at least partially collapsed manner to facilitate transportation and/or storage of the apparatus.

These and other objects, features and advantages of the present invention will become more apparent when the drawings as well as the detailed description are taken into consideration.

BRIEF DESCRIPTION OF THE DRAWINGS

FIG. 1 also illustrates an individual using the stretching apparatus in an exemplary stretching position.

Like reference numerals refer to like parts throughout the several views of the drawings provided herein.

DETAILED DESCRIPTION OF THE INVENTION

As shown in the accompanying drawings, and with particular reference to FIGS. 1 through 5, for example, the present invention is directed to a stretching apparatus, generally referenced as 10. As provided herein, the stretching apparatus 10 of at least one embodiment is structured and adapted to assist a user in stretching and/or exercising his or her body, including, but in no way limited to his or her leg(s), arm(s), back, core, etc. In some embodiments, at least a portion of the stretching apparatus 10 is at least partially adjustable in order to accommodate users of different heights, strengths or stretching capabilities.

It should also be noted that the stretching apparatus 10 of some embodiments of the present invention is lightweight and thus easily moved or transported. For example, one or more portions of the apparatus 10 can be constructed of, or substantially constructed of, a light weight wood or other like material such that the entire apparatus 10 can be easily lifted and transported by any individual or user. This allows a user to easily transport the apparatus from one location to another, as desired, or to store the apparatus 10, for example, in a closet or other storage location, when not in use.

Figure 1:
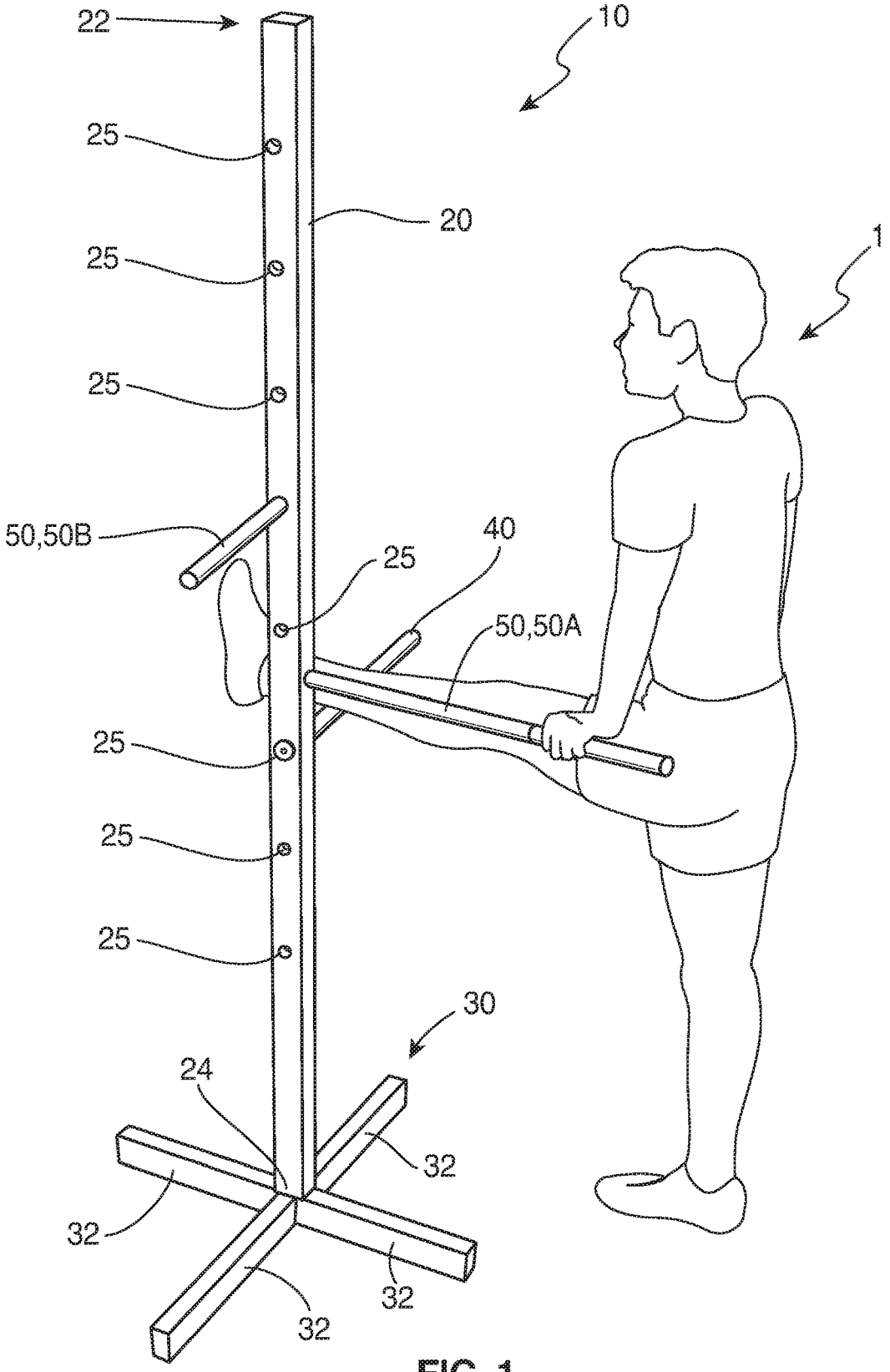
FIG. 1 is a front left perspective view of the stretching apparatus disclosed in accordance with at least one embodiment of the present invention.

Still referring to FIG. 1, the stretching apparatus 10 of at least one embodiment includes a main or vertical post 20 with a top end 22 and a bottom end 24, the top end 22 being opposite the bottom end 24. As shown, the main or vertical post 20 may be a substantially elongated, straight, or vertically oriented post or stanchion disposed in an upright position with the bottom end 24 thereof supported by a base 30. Other configurations of the post 20 are contemplated within the full spirit and scope of the present invention such that the post 20 may be at least partially curved, angled, etc. or otherwise not necessarily disposed in a substantially vertically oriented and straight configuration, as shown in the figures.

Moreover, the base 30 of at least one embodiment may include at least one outwardly disposed base member 32 or flare that provides stability and support to the vertical post 20. For example, the base 30 may be connected to or attached to or proximate to the bottom end 24 or a portion of the vertical post 20 via one or more brackets (not shown), screws, mounts, holes, etc. Although the embodiment illustrated in FIG. 1 shows the base 30 as comprising four (4) outwardly disposed legs or base members 32, other configurations capable of supporting the vertical post 20 in an upright manner are contemplated.

Furthermore, the stretching apparatus 10 of at least one embodiment includes at least one horizontal or adjustable support bar 40. The one or more horizontal or adjustable support bars 40 extends outward in a substantially horizontal orientation from the main or vertical post 20. As provided in the figures, and as described herein, and with particular reference to FIGS. 4 and 5, for example, the horizontal or adjustable support bar(s) 40 may be selectively positioned at different vertical positions or heights along the vertical post 20.

It should be noted that the selective positioning of the horizontal or adjustable support bar(s) 40 can create different configurations of the stretching apparatus 10 of the present invention. For example, by raising the one or more adjustable support bar(s) 40 to a higher vertical position, a more challenging or more advanced stretching position may be required.

Particularly, with reference to FIG. 1, as just an example, the stretching apparatus 10 of at least one embodiment may be used to stretch a user's leg. In the illustration, the user 1 has one leg extended in a substantially perpendicular position relative to his body or other leg. Specifically, one leg is supported on the horizontal support bar 40, while the other leg remains supported on the ground. If the user were to raise the horizontal support bar 40 to a higher position, then using the same stretching technique as shown in FIG. 1, a more challenging or advanced position is required in that the user will have to raise his or her leg to a higher position to achieve the same supporting orientation upon the bar 40. Conversely, if the user were to lower the horizontal support bar 40 to a lower position, using the same stretching technique shown, an easier or more novice stretching position is required.

It should be noted and apparent that the stretching position or technique illustrated in FIG. 1 is provided for exemplary purposes only and should not be considered limiting in any manner. For example, the user 1 can use the stretching apparatus 10 of the present invention in a variety of different stretching positions or techniques to stretch various portions of the user's legs, arms, back, etc. by raising and lowering the horizontal support bar(s) 40, by supporting different portions of his or her body on the one or more horizontal support bar(s) 40, etc.

Furthermore, with reference to FIG. 1 through 5, in at least one embodiment, the vertical post 20 includes a plurality of holes 25 disposed there through. In some embodiments, the holes 25 may pass completely though the post 20 from one side to another. The holes 25 may be disposed along the post 20 in a vertically spaced relation between the bottom end 24 and the top end 22 of the post 20. For instance, the holes 25 may be disposed at different heights or different vertical positions along the post 20. As best shown in the exploded views of FIGS. 4 and 5, the one or more height-adjustable horizontal support bars 40 may be selectively positioned at least partially through the plurality of holes 25. In this regard, a single horizontal support bar 40 may be selectively positioned at least partially through one of the plurality of holes 25 at a time. Specifically, if desired, the user can remove the support bar 40 from one of the holes 25 and position the same support bar 40 into a different one of the plurality of holes 25 in order to adjust the height or position of the support bar 40.

Figure 4:
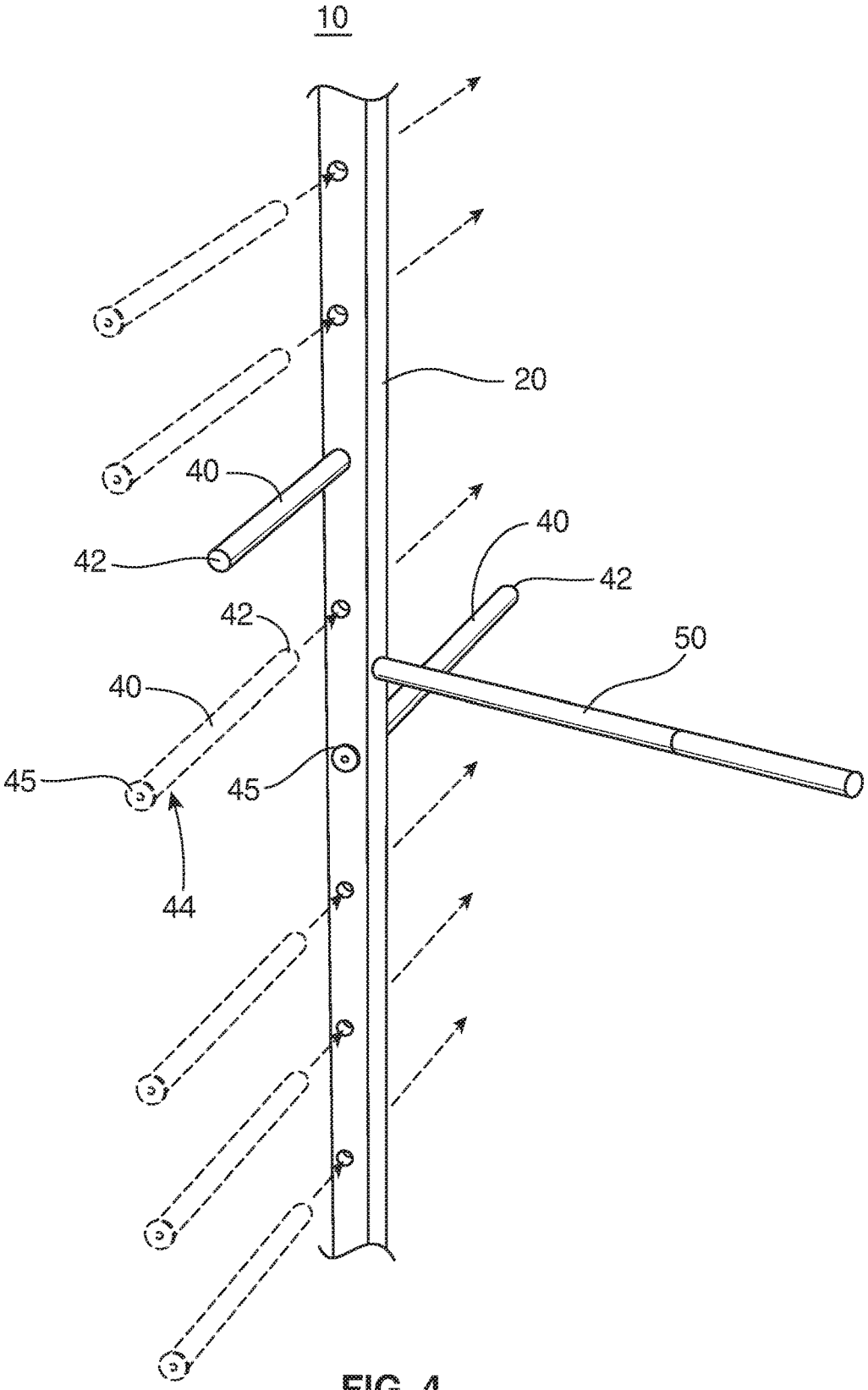
FIG. 4 is a partial cut-away left perspective exploded view of at least one embodiment of the stretching apparatus as disclosed herein.
Figure 5:
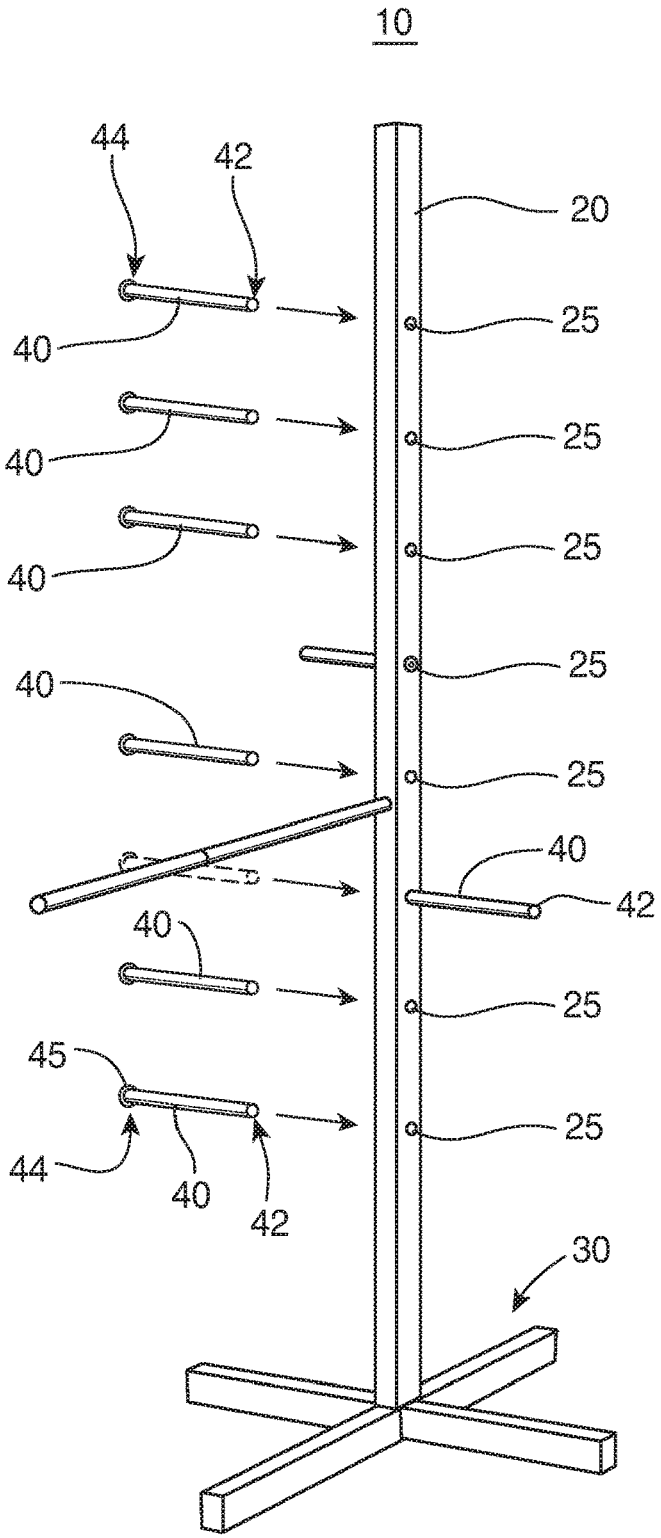
FIG. 5 is a right perspective exploded view of at least one embodiment of the stretching apparatus as disclosed herein.

For instance, still referring to FIGS. 4 and 5, the height-adjustable support bar(s) 40 of at least one embodiment include a distal end 42 and a proximal end 44 disposed opposite one another. A stopper 45 is disposed at or near the proximal end 44 of the adjustable support bar(s) 40. The stopper 45 is structured and configured to restrict movement of the horizontal or height-adjustable support bar 40 from being disposed completely through the hole 25.

More specifically, in order to selectively position the horizontal or height-adjustable support bar 40 through one of the plurality of holes 25, the distal end 42 thereof is first inserted through one side of the hole 25, as illustrated in FIGS. 4 and 5. The bar 40 will then slide through the hole 25 until the stopper 45 restricts further movement. In this manner, the stopper 45 of at least one embodiment includes an enlarged configuration compared to the shape and size of the bar 40, itself, and the hole 25. The stopper 45 of at least one embodiment, thus includes a size and configuration that is at least partially larger than the hole 25, thereby preventing the stopper 45 from passing into and/or through the hole 25.

In this manner, the stopper 45 may include an enlarged end or flared portion of the bar 40 that includes a size and/or shape incapable of passing all the way through the hole 25. In some embodiments, the stopper 45 may be formed as part of the bar 40, such that the bar 40 and the stopper 45 comprise a one-piece construction. In other embodiments, however, the stopper 45 may be a separate piece (such as a metal or wood disc, ball or other structure capable of facilitating the stopping capabilities of the stopper 45 described herein) that is attached, preferably fixedly attached (e.g., via one or more screws, bolts, nails, or adhesive) to the proximal end 44 of the height-adjustable support bar 40. Although the stopper 45 is shown in the figures as comprising a circular or rounded configuration, other configurations are contemplated within the full spirit and scope of the present invention to achieve the intended goal of restricting movement of the stopper 45 and/or height-adjustable support bar 40 completely through the hole 25.

It should also be noted that in some embodiments, the height-adjustable support bar(s) 40 of at least one embodiment may be positioned through either side of the hole(s) 25, as generally shown in FIG. 4, for example.

Furthermore, in at least one embodiment, the present invention also includes one or more fixed support bar or handle, generally referenced as 50. The fixed support bar(s) or handle(s) 50 are fixedly attached to a portion of the vertical post 20 and are not intended to be readily removed, moved or adjusted, for example, to different heights. Rather, the fixed support bar(s) 50 of at least one embodiment are fixedly secured to the vertical post 20 and can provide additional support or leverage for the user 1 during operation of the stretching apparatus 10. In some embodiments, for instance, the fixed support bar(s) 50 may be screwed into the vertical post 20 or otherwise attached in a fixed manner, such as via one or more nails, bolts, adhesive, etc.

With reference to FIG. 1, for example, the embodiment illustrated includes two (2) fixed support bars 50. The user 1 is holding onto to one of the two fixed support bars 50 with his left hand, whereas the other fixed support bar 50 is not being used in the exercise or stretch shown. Rather, the other fixed support bar 50 (e.g., the one not being used in FIG. 1) can be used as support or leverage during other stretches or exercises (not shown).

Figure 2:
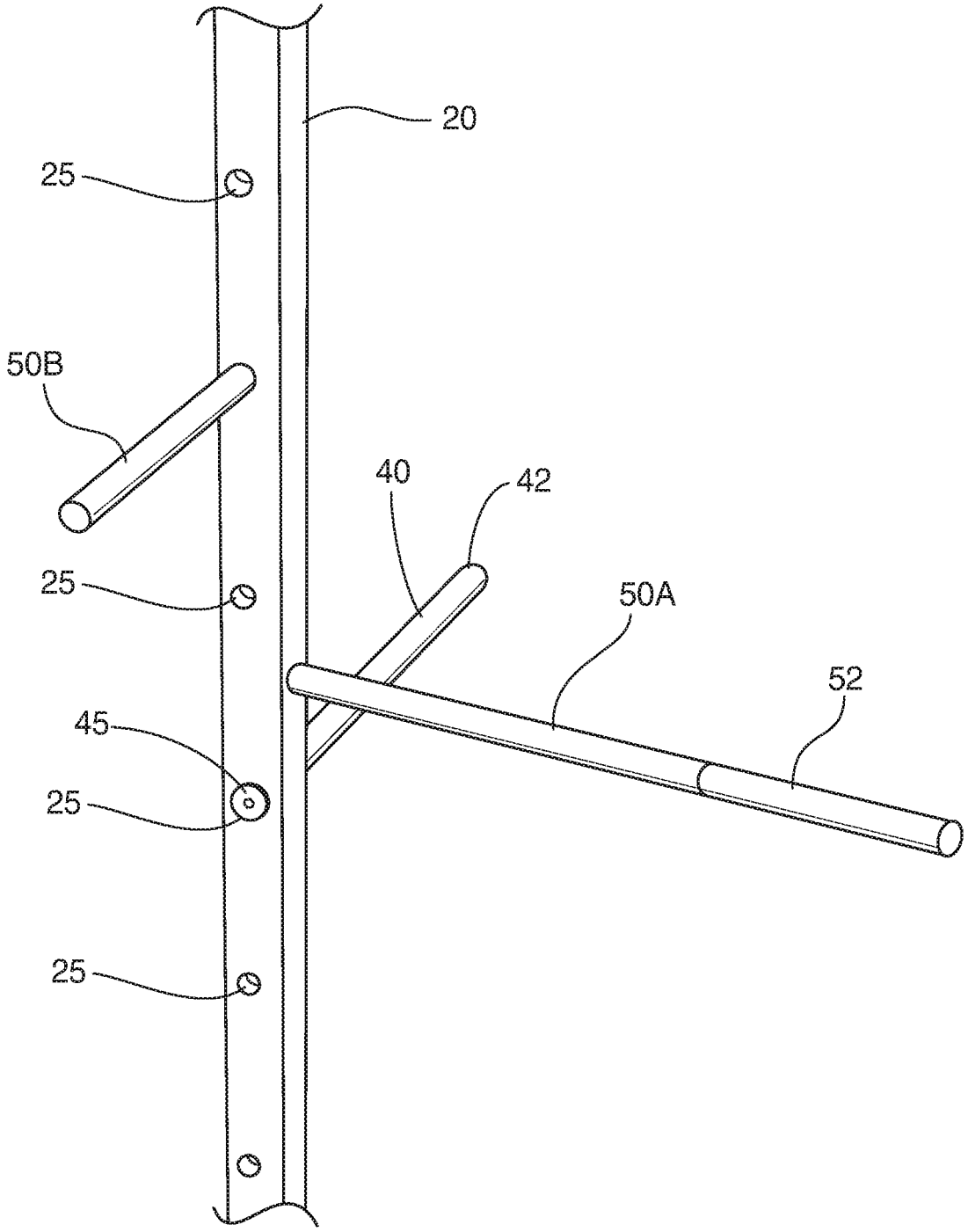
FIG. 2 is a partial cut-away and front left perspective view of the stretching apparatus as disclosed in accordance with at least one embodiment of the present invention.
Figure 3:
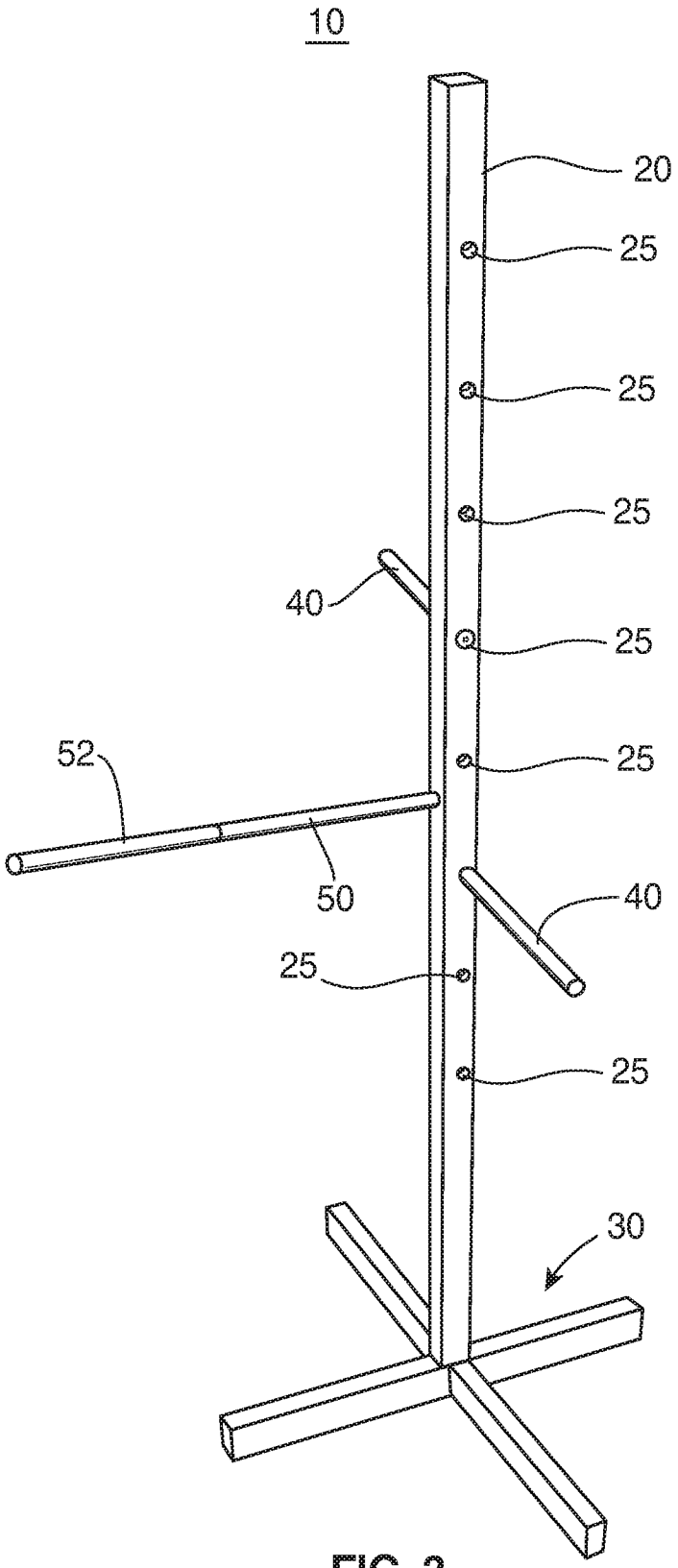
FIG. 3 is a right perspective view of the stretching apparatus as disclosed in accordance with at least one embodiment of the present invention.

Furthermore, referring to the embodiment illustrated in FIG. 2, for example, at least one of the fixed support bars 50A is at least substantially perpendicular and at least partially vertically offset to the one or more height-adjustable support bars 40. In this manner, the fixed support bar 50A can extend at least substantially horizontal or outward from the vertical post 20 in an manner perpendicular to the height-adjustable support bar 40, although in a plane that is at least partially vertically offset. In one embodiment, the fixed support bar 50, 50A has a length greater than that of the height-adjustable support bar 40. In this manner, as best shown in FIG. 1, the user 1 can stand back from the vertical post 20 a distance that is comfortable while using the fixed support bar 50A as support with his or her hand and supporting a foot, ankle or calf upon one of the height-adjustable support bars 40. Of course, as mentioned above, this position is merely exemplary and should not be deemed limiting in any manner.

Specifically, some embodiments may include a fixed support bar 50B that is at least substantially parallel to the at least one height-adjustable support bar. Again, the fixed support bar 50 may be and at least partially vertically offset from the height-adjustable support bar, but need not necessarily be. As shown in FIG. 2, for example, at least one embodiment may include a plurality of at least two fixed support bars 50A, 50B. In the embodiment illustrated, the fixed support bars 50A, 50B are at least substantially perpendicular to one another and at least partially vertically offset. Other combinations, positions and orientations of fixed support bars 50 are contemplated within the full spirit and scope of the present invention.

In addition, at least one embodiment of the present invention may include one or more gripping elements or gripping components 52 disposed on or along one or more of the various support bars, such as the fixed support bar(s) 50 and/or height-adjustable support bar(s) 40. The gripping elements 52 may include gripping tape, foam piece, etc. structured to provide a soft, secure or gripping surface that user can comfortably grab onto or rest one or more body portion thereon.

The combination of the height-adjustable support bar(s) 40 and the fixed support bars 50 provide a multitude of different possibilities for stretching and exercising various portions of a user's body, as needed or as desired, for example, the user's leg(s), arm(s), back, core, etc.

Further structural features of certain embodiments of the present invention are directed to the material used and/or the cross-sectional configuration of at least some of the components. For example, in at least one embodiment, the vertical post 20 may be at least substantially constructed of wood, for example, a lightweight wood. For example, some portions of the vertical post 20 (such as any brackets, screws, bolts, mounting hardware, etc.) may comprises other materials or materials different than the rest of the vertical post 20. As just an example, a lightweight wood can be pine, fir, spruce or cedar types of wood. Although other harder, denser or heavier woods can be used. Furthermore, the vertical post 20 may include a rectangular or square cross-section configuration. In this manner, the vertical post 20 of at least one embodiment may be constructed of a 2×4, 1×4, 2×2 or other rectangular or square shaped lumber.

Furthermore, in at least one embodiment, one or more of the height-adjustable horizontal support posts 40 and/or the fixed support posts 50 may be at least substantially constructed of a lightweight, yet durable and strong wood. For example, some portions of the post(s) 40, 50 (such as the stopper 45, gripping member(s) or portion(s) 52, brackets, screws, bolts, mounting hardware, etc.) may comprises other materials or materials different than the rest of the support post(s) 40, 50. In any event, similar to the vertical post 20, the support posts 40, 50 can be constructed of pine, fir, spruce or cedar types of wood, although other harder, denser or heavier woods can be used. Furthermore, in at least one embodiment, at least some of the support post(s) 40 may include a rounded or circular cross-sectional configuration. This can help comfortably support a user's hand, arm, leg, or other portion of the body during use.

Moreover, in some embodiments, the base 30 can also be constructed of wood, similar to the vertical post 20 and support posts 40, 50. This allows the product, as a whole, to be lightweight, yet durable such that it can be easily manipulated or moved, as desired.

It should be noted, however, that other materials, including lightweight aluminum, metals or plastics can also be used in the construction of the vertical post 20, support posts 40, 50 and/or the base 30 of the various embodiments herein.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. A stretching apparatus, comprising:

a vertical post comprising a bottom end supported by a base;

said vertical post comprising a plurality of holes disposed therethrough, said plurality of holes being disposed along said vertical post in a vertically spaced relation to one another;

at least one horizontal support bar selectively positionable at least partially through one of said plurality of holes at a time, said at least one horizontal support bar comprising a proximal end and a distal end;

a stopper disposed at said proximal end of said at least one horizontal support bar, said stopper configured to restrict movement of said at least one horizontal support bar from being disposed completely through said each of said plurality of holes;

a plurality of fixed support bars respectively extending outward from said vertical post, each of said plurality of fixed support bars being fixedly attached to said vertical post at a position below at least two of the plurality of holes so as to allow a user to lean on one of said plurality of fixed support bars with an arm of the user extended downward while an ankle of the user rests on said at least one horizontal support bar; and wherein said distal end of said at least one horizontal support bar is selectively disposable through one of said plurality of holes disposed along said vertical post, and said at least one horizontal support bar is positionable through said one of said plurality of holes until said stopper restricts further movement of said at least one horizontal support bar therethrough.

2. The stretching apparatus as recited in claim 1 wherein said at least one horizontal support bar and/or said plurality of fixed support bars respectively comprises a gripping material disposed thereon.

3. The stretching apparatus as recited in claim 2 wherein said plurality of fixed support bars are at least substantially constructed of wood.

4. The stretching apparatus as recited in claim 1 wherein said at least one horizontal support bar comprises a round cross-section.

5. The stretching apparatus as recited in claim 1 wherein said vertical post comprises a rectangular cross-section.

6. The stretching apparatus as recited in claim 1 wherein said vertical post at least substantially constructed of wood.

7. The stretching apparatus as recited in claim 6 wherein said at least one horizontal support bar is at least substantially constructed of wood.

8. The stretching apparatus as recited in claim 7 wherein said base is at least substantially constructed of wood.

9. A lightweight stretching apparatus, comprising:

a vertical post comprising a top end and a bottom end;

a base, said base is being attached to said bottom end of said vertical post and structured to support said vertical post in an upright position;

said vertical post comprising a plurality of holes disposed completely therethrough, each of said plurality of holes being disposed at a different height between said bottom end and said top end of said vertical post;

at least one height-adjustable support bar selectively positionable at least partially through one of said plurality of holes at a time, said at least one height-adjustable support bar being selectively positionable at least partially through a different one of said plurality of holes to adjust a height of said at least one height-adjustable support bar, said at least one height-adjustable support bar comprising a proximal end and a distal end;

a stopper disposed at said proximal end of said at least one height-adjustable support bar;

said stopper configured to restrict movement of said at least one height-adjustable support bar from being disposed completely through said plurality of holes, wherein said distal end of said at least one height-adjustable support bar is selectively disposable through one of said plurality of holes disposed along said vertical post, said at least one height-adjustable support bar being slidingly positionable through said one of said plurality of holes until said stopper restricts further movement of said at least one height-adjustable support bar therethrough;

a plurality of fixed support bars respectively extending outward from said vertical post, each of said plurality of fixed support bars being fixedly attached to said vertical post at a position below at least two of the plurality of holes;

wherein at least one of said plurality of fixed support bars is at least substantially perpendicular to and at least partially vertically offset from said at least one height-adjustable support bar when said at least one height adjustable support bar is positioned at least partially through one of said plurality of holes;

wherein a different one of said plurality of fixed support bars is at least substantially parallel to and at least partially vertically offset from said at least one height-adjustable support bar when said at least one height-adjustable support bar is positioned at least partially through one of said plurality of holes;

the substantially perpendicular fixed support bar further comprising a height above the base, the height above the base configured to be at about a height of a waist of a user and having a length configured to be about a leg length of the user as measured from an ankle of the user to the user's waist; and wherein the lightweight stretching apparatus is configured such that the user can stand back from the vertical post a distance that is comfortable while using the substantially perpendicular fixed support bar to support an arm of the user extended downward while a leg of the user is extended forward to rest a foot or the ankle or a calf of the user upon said at least one height-adjustable support bar.

10. The stretching apparatus as recited in claim 9 wherein at least two of said plurality of fixed support bars are at least substantially perpendicular to and at least partially vertically offset from one another.

11. The stretching apparatus of claim 9, wherein the different one of said plurality of fixed support bars is located higher than the substantially perpendicular fixed support bar.

12. The stretching apparatus of claim 11, wherein the base comprises a plurality of outwardly disposed legs to support the vertical post in the upright position.

13. The stretching apparatus of claim 11, wherein the vertical post further comprises a square cross-section.

14. A stretching pole apparatus comprising:

a base to support a stretching pole vertically on a flat surface;

said stretching pole having a plurality of left to right through holes ascending vertically up the stretching pole;

one positionable stretch peg selectively insertable through any one left to right through hole and configured to support an ankle of a user thereon;

one fixed support pole fixed to the stretching pole, and extending forward from and perpendicular to the one positionable stretch peg, the one fixed support pole configured to be at about a height of a waist of the user;

said one fixed support pole having a length configured to be about a leg length of the user as measured from the ankle of the user to the user's waist;

a fixed hand peg located above the one fixed support pole and parallel to the one positionable stretch peg; and wherein the stretching pole apparatus is configured such that the user can stand back from the stretching pole a distance that is comfortable while resting the ankle on the one positionable stretch peg, supporting an arm of the user extended downward on the one fixed support pole, and grabbing the fixed hand peg.

* * * * *